US010451070B2

(12) United States Patent
Wang et al.

(10) Patent No.: US 10,451,070 B2
(45) Date of Patent: Oct. 22, 2019

(54) SLIDING VANE COMPRESSOR AND EXHAUST STRUCTURE THEREOF

(71) Applicant: Gree Green Refrigeration Technology Center Co., Ltd. of Zhuhai, Zhuhai (CN)

(72) Inventors: Pengkai Wang, Zhuhai (CN); Jia Xu, Zhuhai (CN); Liping Ren, Zhuhai (CN); Fayou Luo, Zhuhai (CN); Fei Wu, Zhuhai (CN)

(73) Assignee: Gree Green Refrigeration Technology Center Co., Ltd. of Zhuhai, Zhuhai (CN)

( * ) Notice: Subject to any disclaimer, the term of this patent is extended or adjusted under 35 U.S.C. 154(b) by 268 days.

(21) Appl. No.: 15/525,808

(22) PCT Filed: Aug. 27, 2015

(86) PCT No.: PCT/CN2015/088304
§ 371 (c)(1),
(2) Date: May 10, 2017

(87) PCT Pub. No.: WO2016/119456
PCT Pub. Date: Aug. 4, 2016

(65) Prior Publication Data

US 2017/0342982 A1 Nov. 30, 2017

(30) Foreign Application Priority Data

Jan. 28, 2015 (CN) ..... 2015 1 0044276

(51) Int. Cl.
*F04C 29/12* (2006.01)
*F04C 18/344* (2006.01)

(52) U.S. Cl.
CPC ..... *F04C 29/12* (2013.01); *F04C 18/344* (2013.01)

(58) Field of Classification Search
CPC ..... F04C 29/12; F04C 18/344
See application file for complete search history.

(56) References Cited

U.S. PATENT DOCUMENTS 3,900,277 A * 8/1975 Newton ..... F04C 29/12 418/184
6,030,195 A 2/2000 Pingston

FOREIGN PATENT DOCUMENTS

CN 85200749 U 2/1987
CN 1264454 A 8/2000
(Continued)

*Primary Examiner* — Mary Davis
(74) *Attorney, Agent, or Firm* — The Webb Law Firm

(57) ABSTRACT

Disclosed are a sliding vane compressor and an exhaust structure thereof. The exhaust structure of the sliding vane compressor includes: an exhaust hole, the exhaust hole being formed in a flange of the sliding vane compressor and being in communication with a compression cavity of a cylinder of the sliding vane compressor; a guide channel, the guide channel being formed on the flange and penetrating through the flange; and an exhaust channel, the exhaust channel being formed on an eccentric circle of the sliding vane compressor, and the exhaust channel being used for communicating the compression cavity with the guide channel using the rotation of the eccentric circle. The sliding vane compressor and the exhaust structure thereof have a small exhaust loss, thereby effectively reducing the power consumption and the production and manufacturing costs of the sliding vane compressor.

9 Claims, 3 Drawing Sheets

(56) References Cited

FOREIGN PATENT DOCUMENTS

| | | | | | |
|---|---|---|---|---|---|
| CN | 102128168 | A | | 7/2011 | |
| CN | 203335407 | U | | 12/2013 | |
| CN | 203796573 | U | | 8/2014 | |
| CN | 104302923 | A | * | 1/2015 | ..... F04C 18/3441 |
| CN | 204419597 | U | | 6/2015 | |
| JP | 59103982 | A | | 6/1984 | |
| JP | 59103984 | A | | 6/1984 | |
| JP | 2014141962 | A | | 8/2014 | |
| WO | 2013172144 | A1 | | 11/2013 | |

* cited by examiner

SLIDING VANE COMPRESSOR AND EXHAUST STRUCTURE THEREOF

CROSS-REFERENCE TO RELATED APPLICATIONS

This application is the United States national phase of International Application No. PCT/CN2015/088304 filed Aug. 27, 2015, and claims priority to Chinese Patent Application No. 201510044276.4 filed Jan. 28, 2015, the disclosures of which are hereby incorporated in their entirety by reference.

FIELD OF THE INVENTION

The present application relates to the field of air conditioners, and more particularly, to a sliding vane compressor and an exhaust structure thereof.

BACKGROUND OF THE INVENTION

Referring to FIGS. 1 and 2, most of current sliding vane compressors are provided with a cylinder 1 side exhaust structure. In order to ensure the normal use of various working conditions, besides usually providing an exhaust port 2 and an exhaust valve disc at a compression ending position, an intermediate exhaust port 4 is also provided at a middle position of a compression cavity 3. Further, an exhaust valve disc (also referred to as a pressure relief valve) is also provided to prevent overpressure in a low load working condition. At the same time, due to structural constraints, the sliding vane compressor side exhaust has a smaller effective area but a larger exhaust resistance and loss, consequently a lower energy efficiency. In addition, due to a large clearance volume existing in the exhaust port 2, the remaining gas cannot be discharged from a bump body of the sliding vane compressor. As the sliding vane continues to rotate, the remaining high pressure gas expands to a lower pressure chamber therebehind, which needs to repeat the compression, thereby wasting power consumption of the sliding vane compressor.

SUMMARY OF THE INVENTION

A main objective of the present application is to provide a sliding vane compressor and an exhaust structure thereof, which could reduce production cost of sliding vane compressors and reduce exhaust loss thereof.

In order to achieve the above objective, according to an aspect of the present application, there is provided an exhaust structure of a sliding vane compressor, comprising: a vent hole provided on a flange of the sliding vane compressor and in communication with a compression cavity of an air cylinder of the sliding vane compressor; a guiding passage provided on the flange and through the flange; and an exhaust passage provided on an eccentric circle of the sliding vane compressor, the exhaust passage being for communicating the compression cavity and the guiding passage with rotation of the eccentric circle.

Further, the guiding passage extends from the vent hole in a direction in which a refrigerant in the compression cavity is compressed.

Further, an extending track of the guiding passage is an arc, a convex direction of the arc being far away from a central axis of the flange.

Further, a width of the guiding passage is in a range from 2 mm to 10 mm.

Further, the exhaust passage extends from an outer edge of the eccentric circle in a direction close to an axis of the eccentric circle.

Further, a port of the exhaust passage located at the outer edge of the eccentric circle is adjacent to a sliding vane groove on the eccentric circle.

Further, the exhaust passage is an exhaust notch or a through hole.

Further, a cross-sectional area of the exhaust passage is in a range from 0.5 $mm^2$ to 1.5 $mm^2$.

Further, a plurality of the exhaust passages are provided in one-to-one corresponding to a plurality of sliding vane grooves of the eccentric circle, the sliding vane grooves for mounting a plurality of sliding vanes.

According to another aspect of the present application, there is a sliding vane compressor comprising the above exhaust structure.

By applying the technical solutions of the present application, during working, the compressed refrigerant could enter into the vent hole directly from the compression cavity and then be exhausted. The remaining refrigerant can also enter into the guiding passage through the exhaust passage and be then exhausted. Compared with the prior art structure of providing a side exhaust port and an exhaust valve disc at a side of the air cylinder, the vent hole of the exhaust structure of the present sliding valve compressor can be set without being limited by the structure of the air cylinder, resulting in a large effective exhaust area. Besides, when the sliding vane type compressor exhausts gas, the sliding value type compressor needn't overcome the rigidity of the exhaust valve disc per se, such that the exhaust pressure is equal to back pressure, effectively reducing power consumption and manufacturing costs of the sliding vane compressor.

BRIEF DESCRIPTION OF THE DRAWINGS

The accompanying drawings, which constitute a part of the present application, are to provide a further understanding of the present application. Illustrative embodiments of the present application and depictions thereof are intended to explain the present application, not for exclusively limiting the present application. In the drawings.

Figure 1:
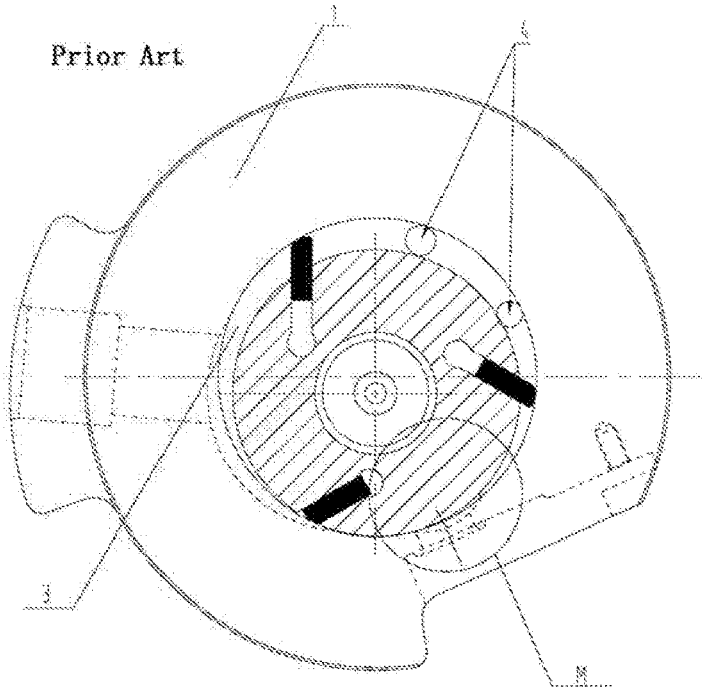
FIG. 1 schematically shows a front view of an exhaust structure of a prior art sliding vane compressor.
Figure 2:
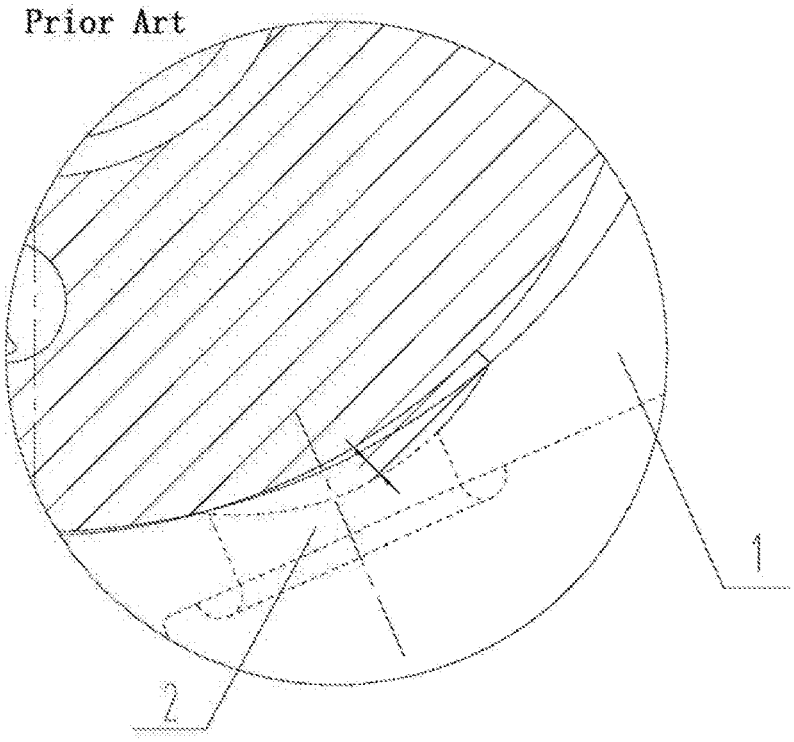
FIG. 2 schematically shows an enlarged view of the M region in FIG. 1.

Particularly, the drawings above include the following reference numerals:

10. Vent hole; 20. Guiding passage; 30. Exhaust passage; 40. Upper flange; 50. Air cylinder; 51. Compression cavity; 60. Eccentric circle; 61. Sliding vane groove; 70. Rotary shaft; 80. Sliding vane.

DETAILED DESCRIPTION OF THE PREFERRED EMBODIMENTS

It is to be noted that the features in the embodiments and examples in the present application may be combined with each other without conflict. Hereinafter, the present application will be described in detail with reference to the accompanying drawings.

Figure 3:
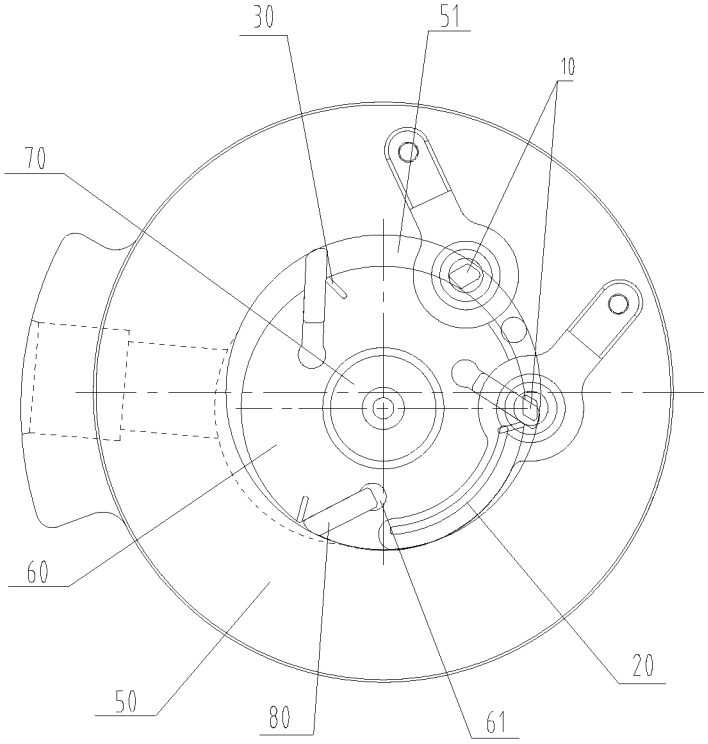
FIG. 3 schematically shows a front view of an exhaust structure of a sliding vane compressor of the present application.
Figure 4:
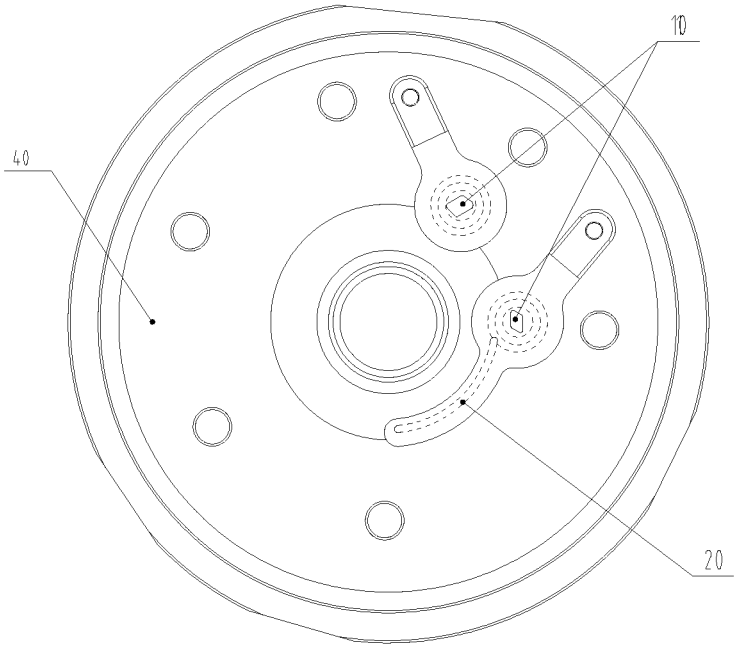
FIG. 4 schematically shows a top view of an upper flange on a sliding vane compressor of the present application.
Figure 5:
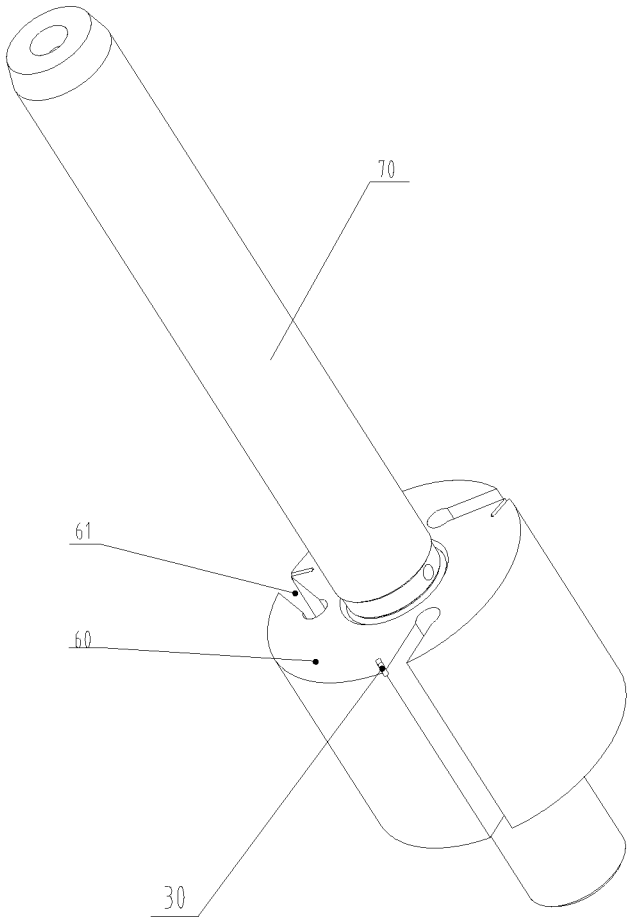
FIG. 5 schematically shows a stereoscopic diagram when an eccentric circle of the sliding compressor of the present application is mounted on a rotary shaft.

Referring to FIGS. 3 to 5, according to an embodiment of the present application, there is provided a sliding vane compressor. The sliding vane compressor includes a housing (not shown), a pump body (not shown), an air cylinder 50, and an upper flange 40 and a lower flange (not shown). The housing encloses a mounting cavity for mounting the pump body, the air cylinder, and the upper and lower flanges. The pump body includes a rotary shaft 70 and an eccentric circle 60 provided on the rotary shaft 70. A sliding vane groove 61 for mounting the sliding vane 80 is provided on the eccentric circle 60.

During mounting, the rotary shaft 70 is mounted on and passes through the air cylinder 50; the eccentric circle 60 is provided within the compression cavity 51 of the air cylinder 50; the sliding vane 80 is mounted within the sliding vane groove 61. The air cylinder 50 is fixed within the mounting cavity enclosed by the housing through the upper and lower flanges. When the sliding vane compressor is operated, the rotary shaft 70 is rotated to further rotate the eccentric circle 60 within the compression cavity 51 so as to compress the refrigerant within the air cylinder 50; the refrigerant is exhausted out of the air cylinder 50 through the exhaust structure of the sliding vane compressor.

The exhaust structure of the sliding vane compressor in this embodiment includes an vent hole 10, a guiding passage 20 and an exhaust passage 30. The vent hole 10 is provided on a flange of the sliding vane compressor, which may be an upper flange or a lower flange of the sliding vane compressor, preferably the upper flange 40, and is in communication with the compression cavity 51 of the air cylinder 50; the guiding passage 20 is provided on the flange and passes through the flange along a thickness direction of the flange; the exhaust passage 30 is provided on the eccentric circle 60 on the rotary shaft 70, for communicating the compression cavity 51 and the guiding passage 20 with the rotation of the eccentric circle 60.

In operation, the compressed refrigerant directly enters from the compression cavity 51 into the vent hole 10 and then be exhausted, and the remaining refrigerant also enters through the exhaust passage 30 into the guiding passage 20 and is exhausted. Compared with the prior art structure of providing a side exhaust port and an exhaust valve disc at a side of the air cylinder, the vent hole 10 of the exhaust structure of the present sliding valve compressor may be set autonomously without being limited by the structure of the air cylinder 50, resulting in a large effective exhaust area. Besides, when the sliding vane compressor exhausts the remaining refrigerant, the sliding value type compressor needn't overcome the rigidity of the exhaust valve disc per se, such that the exhaust pressure is equal to back pressure, effectively reducing power consumption and manufacturing costs of the sliding vane compressor.

In the present embodiment, the guiding passage 20 extends from the vent hole 10 in a direction in which the refrigerant in the compression cavity 51 is compressed, thereby facilitating exhaust of the high-temperature high-pressure refrigerant remaining in the compression cavity 51 out of the compression cavity 51.

Preferably, an extending track of the guiding passage 20 is an arc, a convex direction of the arc being away from a central axis of the flange. This arrangement can reduce a length of the exhaust passage 30 and reduce power consumption of the sliding vane compressor, thereby facilitating the exhaust passage 30 to communicate the compression cavity 51 and the vent hole 10 during rotation of the eccentric circle 60, and further exhausting the high-temperature and high-pressure gas in the compression cavity 51 out of the compression cavity 51.

In the present application, a plurality of the vent holes 10 are provided. The plurality of vent holes 10 and the guiding passage 20 are sequentially arranged in a direction in which in which the refrigerant in the compression cavity 51 is compressed. When the eccentric circle 60 is closest to the last vent hole 10 arranged in the direction in which the refrigerant is compressed, the guiding passage 20 is located between the vent hole 10 and a minimum gap between the eccentric circle 60 and the compression cavity 51, more facilitating gas exhaust.

Preferably, a width of the guiding passage 20 is in a range from 2 mm to 10 mm, for example 6 mm, which guarantees smoothness of exhaust.

Referring to FIG. 3 and FIG. 5, the exhaust passage 30 in the present embodiment extends from an outer edge of the eccentric circle 60 in a direction close to an axis of the eccentric circle 60, which facilitates communicating the exhaust passage 30 with the guiding passage 20 as the eccentric circle 60 rotates.

Preferably, a port of the exhaust passage 30 at the outer edge of the eccentric circle 60 is close to the sliding vane groove 61 for mounting the sliding vane 80 of the eccentric circle 60, which facilitates complete exhaust of the refrigerant in the compression cavity 51 outside of the air cylinder 50. After the exhaust ends, its clearance volume is only a small clearance formed by the exhaust passage 30, which is even smaller than the clearance resulting from providing an exhaust port on a side of the air cylinder, thereby facilitating increase of a refrigerating capacity of the sliding vane compressor, reduction of power consumption of the sliding vane compressor, and enhancement of energy efficiency of the sliding vane compressor.

Preferably, the exhaust passage 30 is an exhaust notch or a through hole, which is simple in structure and easy to implement. The shape in the present embodiment may be modified according to the actual needs, which only requires that, the sliding vane 80, after passing through all vent holes 10, be communicated with the guiding passage 20 of the flange.

A cross-sectional area of the exhaust passage 30 in the present embodiment is determined depending on the size of the remaining exhaust cavity. It is generally preferable that the cross-sectional area of the exhaust passage 30 is in the range from 0.5 $mm^2$ to 1.5 $mm^2$ to ensure smoothness of gas exhaust. A plurality of the exhaust passages 30 are provided in the present embodiment, one-to-one corresponding to a plurality of sliding vane grooves 61 for mounting a plurality of sliding vanes of the eccentric circle 60, facilitating quickly exhausting the high-temperature high-pressure refrigerant in the compression cavity 51 completely out of the air cylinder 50, thereby enhancing performance of the sliding vane compressor.

When the sliding vane compressor is working and the exhaust passage 30 rotates to communicate with the guiding passage 20, it communicates with back pressure exhaust, and the remaining gas is exhausted from the exhaust passage 30 through the guiding passage 20. The back pressure here refers to the pressure within the entire housing of the sliding vane compressor (a pressure formed after when being exhausted in the housing after compression by a pump body of the sliding vane-type compressor, which is discharged through the exhaust passage out of the sliding vane compressor). The back pressure is generally lower than the pressure of the compression cavity in the pump body at the time of exhaust (to exhaust the gas in the pump body, self-rigidity of the valve disc needs to be overcome. Because no valve disc is provided to the guiding passage 20, the remaining refrigerant after passing through the vent hole 10 may be directly exhausted through the guiding channel 20, which may also avoid waste of power consumption when the remaining refrigerant enters into the next compression cycle).

It is seen that the clearance volume of the structure of the sliding vane compressor in the present embodiment is only a small clearance formed by the exhaust passage 30, which is far smaller than the clearance resulting from providing an exhaust port on a side of the air cylinder, thereby facilitating increase of a refrigerating capacity of the sliding vane compressor, reduction of power consumption of the sliding vane compressor, and enhancement of energy efficiency of the sliding vane compressor.

From the depiction above, it may be seen that the above embodiments of the present application achieve the following effects:

1. with the guiding passage structure, no exhaust valve is needed, which saves costs;

2. because the exhaust process needn't overcome self-rigidity of the valve disc, the exhaust loss is small;

3. the exhaust clearance volume is small, which may effectively enhance energy efficiency of the sliding vane compressor.

What have been discussed above are only preferred embodiments of the present application, not for limiting the present application. For those skilled in the art, the present application may have various changes and variations. Any modification, equivalent replacement, improvement within the principle and spirit of the present application should be included within the protection scope of the present application.

The invention claimed is:

1. An exhaust structure of a sliding vane compressor, comprising:

a vent hole provided on a flange of the sliding vane compressor and in communication with a compression cavity of an air cylinder of the sliding vane compressor;

a guiding passage provided on the flange and through the flange; and an exhaust passage provided on an eccentric circle of the sliding vane compressor, the exhaust passage being for communicating the compression cavity and the guiding passage with rotation of the eccentric circle, wherein a width of the guiding passage is in a range from 2 mm to 10 mm.

2. The exhaust structure of a sliding vane compressor according to claim 1, wherein the guiding passage extends from the vent hole in a direction in which a refrigerant in the compression cavity is compressed.

3. The exhaust structure of a sliding vane compressor according to claim 2, wherein an extending track of the guiding passage is an arc, a convex direction of the arc being far away from a central axis of the flange.

4. The exhaust structure of a sliding vane compressor according to claim 1, wherein the exhaust passage extends from an outer edge of the eccentric circle in a direction close to an axis of the eccentric circle.

5. The exhaust structure of a sliding vane compressor according to claim 4, wherein a port of the exhaust passage located at the outer edge of the eccentric circle is adjacent to a sliding vane groove on the eccentric circle.

6. The exhaust structure of a sliding vane compressor according to claim 1, wherein the exhaust passage is an exhaust notch or a through hole.

7. The exhaust structure of a sliding vane compressor according to claim 1, wherein a plurality of the exhaust passages are provided in one-to-one corresponding to a plurality of sliding vane grooves of the eccentric circle, the sliding vane grooves for mounting a plurality of sliding vanes.

8. A sliding vane compressor comprising an exhaust structure according to claim 1.

9. An exhaust structure of a sliding vane compressor, comprising:

a vent hole provided on a flange of the sliding vane compressor and in communication with a compression cavity of an air cylinder of the sliding vane compressor;

a guiding passage provided on the flange and through the flange; and an exhaust passage provided on an eccentric circle of the sliding vane compressor, the exhaust passage being for communicating the compression cavity and the guiding passage with rotation of the eccentric circle, wherein a cross-sectional area of the exhaust passage is in a range from 0.5 $mm^2$ to 1.5 $mm^2$.

* * * * *